United States Patent [19]

Marton

[11] Patent Number: 4,616,449

[45] Date of Patent: Oct. 14, 1986

[54] SUCTION HOUSING FOR VACUUM SANDING DEVICES

[76] Inventor: Miksa Marton, R.R. #1, Old Castle (Windsor), Ontario, Canada, N0R 1L0

[21] Appl. No.: 656,138

[22] Filed: Sep. 28, 1984

[30] Foreign Application Priority Data

Aug. 31, 1984 [ES] Spain ..... 535819

[51] Int. Cl.[4] ..... B24B 55/06

[52] U.S. Cl. ..... 51/273; 51/170 R

[58] Field of Search ..... 51/273, 170 T, 170 MT, 51/170 TL, 170 R

[56] References Cited

U.S. PATENT DOCUMENTS

| | | | |
|---|---|---|---|
| Re. 29,247 | 4/1975 | Kilstrom et al. | 15/380 |
| 2,499,933 | 3/1950 | Smul | 51/187 |
| 2,895,266 | 7/1959 | Statler | 51/180 |
| 2,929,177 | 3/1960 | Sheps | 51/273 |
| 3,123,946 | 3/1964 | Hoveland | 51/186 |
| 3,594,958 | 7/1971 | Cusumano | 51/273 |
| 3,785,092 | 1/1974 | Hutchins | 51/170 |
| 3,824,745 | 7/1974 | Hutchins | 51/170 |
| 3,826,045 | 7/1974 | Champayne | 51/273 |
| 3,862,521 | 1/1975 | Isaksson | 51/273 |
| 3,964,212 | 8/1976 | Karden | 51/170 |
| 4,062,152 | 12/1977 | Mehrer | 51/170 |
| 4,071,981 | 2/1978 | Champayne | 51/170 MT |
| 4,158,935 | 6/1979 | Robert | 51/170 |
| 4,164,101 | 8/1979 | Robert | 51/273 |
| 4,328,645 | 5/1982 | Sauer | 51/170 T |

FOREIGN PATENT DOCUMENTS

| | | | |
|---|---|---|---|
| 931761 | 8/1973 | Canada | 51/65 |
| 1032349 | 6/1978 | Canada | 51/162 |
| 1049265 | 2/1979 | Canada | 51/155 |
| 1063806 | 10/1979 | Canada | 51/65 |
| 1080477 | 7/1980 | Canada | 51/71 |
| 1408522 | 1/1975 | United Kingdom . | |

*Primary Examiner*—Roscoe V. Parker

*Attorney, Agent, or Firm*—Hubbard, Thurman, Turner & Tucker

[57] ABSTRACT

A suction plate for a vacuum sanding device is in the form of a ring or rectangular plate spaced above a backup pad to define a chamber, the periphery of the suction plate is spaced slightly above the backup pad for the whole periphery of the plate and the outer edge of the plate is coterminous, or nearly so, with the edge of the backup pad. In one embodiment, the suction plate is formed of a relatively flexible plastic material. A series of spacers on the backup pad edge or the rim of the suction plate may be used. In a further embodiment a flexible cone or skirt is secured to the housing and extends down over the backup pad and the rim of the suction plate. Projections on the inside of the skirt serve to maintain a space between the latter and the suction plate rim.

9 Claims, 13 Drawing Figures

SUCTION HOUSING FOR VACUUM SANDING DEVICES

FIELD OF THE INVENTION

This invention relates to vacuum sanding devices and in particular to vacuum housings and suction plates for use with such sanding devices.

BACKGROUND OF THE INVENTION

Vacuum sanding devices have been known for sometime. They usually take the form of circular rotary grinders or double action sanders although patents have also issued for vacuum sanders of a rectangular format. Examples of such rectangular vacuum sanders are to be found in U.S. Pat. Nos. 4,062,152 of Dec. 13th, 1977 Mehrer, 3,123,946 of Mar. 10th, 1964 Hoveland, 2,499,933 of Mar. 7th, 1950 Smul. In circular vacuum sanding devices, examples may be found in Applicant's Canadian Patent 1,080,477 Aug. 1st, 1980, Canadian Patent 931,761 to Olmoen, U.S. Pat. Nos. 3,785,092 Hutchins, 2,895,266 Statler, U.S. Pat. Nos. 4,164,101 Robert and 3,862,521 Jan. 28th, 1975.

There are several disadvantages in the construction of the prior art patented devices. Many of them are complicated, incorporating too many moving parts and are therefore expensive to manufacture and maintain. Others do not provide adequate suction adjacent the immediate work area and, if they do, they sometimes have upper housings that are spaced substantially outwardly of the backup pads or sanding blocks so that the sanding blocks can never reach deeply into corners or hard-to-get-at areas.

SUMMARY OF THE INVENTION

The present invention is constructed so as to overcome the many deficiencies of the prior art and to provide a very efficient, light and easy-to-use vacuum sander through the incorporation of a housing that allows a sanding operator to get his sand paper close to if not right at corner portions and hard to get at areas. The housing of the present invention is adapted for use on numerous forms of sanders such as double action or orbital sanders, rotary grinders, rectangular block sanders and hand block sanders. It is also usable on rectangular vibratory sanders.

According to a broad aspect, the invention relates to a suction plate for a vacuum sander of the type including a backup pad, said suction plate having means for spacing said plate above the upper surface of said backup pad, a depending rim on the periphery of said plate defining a relatively narrow peripheral opening between the edge of said plate and said backup pad, the peripheral edge of said rim being coterminous, or nearly so, with the peripheral edge of the backup pad.

In the embodiment of the invention used on orbital or rotary sanders, the peripheral or rim portion of the suction plate reaches down close to the edge of the backup pad and therefore very close to the sanding surface. The plate is therefore instrumental in sucking up dust all around the rim of the operating sander. The backup pads used with vacuum sanders normally have holes in the center part all the way through to an upper chamber formed by a flexible collar extending downwardly from the rotating mechanism to a housing. This combination of the vacuum hole through the backup pad and the peripheral vacuum inlet formed by the housing, forces the suction to draw the dust through the holes and all around the backup pad from the sanded surface. The edge of the suction plate is preferably flexible so that if an operator hits an edge, it gives and flexes back to its original position.

In a rectangular form such as a pole sander or hand sander, again there is a gap between the peripheral rim portion of the suction plate and the upper surface of the backup pad and this causes the vacuum to suck the dust all around and through the edge of the sanding block as well as through apertures in the associated backup pad. The apparatus picks up dust in the front, sides and rear portions equally.

According to a further aspect the invention relates to a suction plate for a backup pad of a vacuum sander, said suction plate extending over the upper surface of the backup pad and having a depending, peripheral rim extending outwardly and downwardly over the edge of the backup pad and defining a narrow peripheral opening between said rim and the adjacent edge of the backup pad; at least one opening in the surface of said plate to provide a path of travel for air drawn into said peripheral opening, through the plate and into a vacuum system of the sander, and a flexible skirt adapted to be secured to said vacuum sander and extending downwardly therefrom over the surface of the rim of said suction ring to, or nearly to a surface to be sanded, and means on the inner side of said skirt to maintain a space between said skirt and the rim of the suction ring.

BRIEF DESCRIPTION OF THE DRAWINGS

The invention is illustrated in the accompanying drawings in which.

Figure 1:
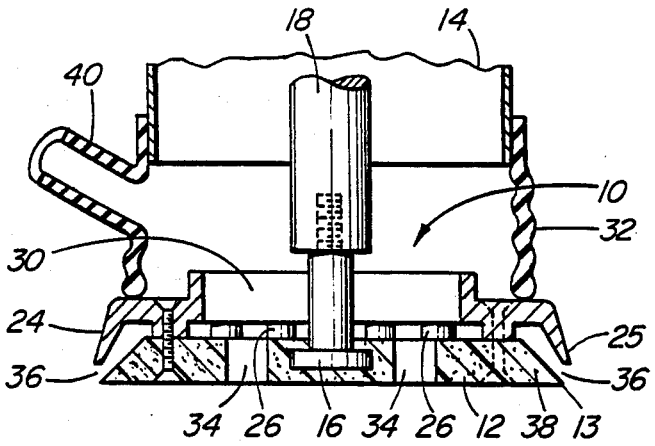
FIG. 1 is a cross sectional view of a vacuum sander incorporating the present invention.
Figure 2:
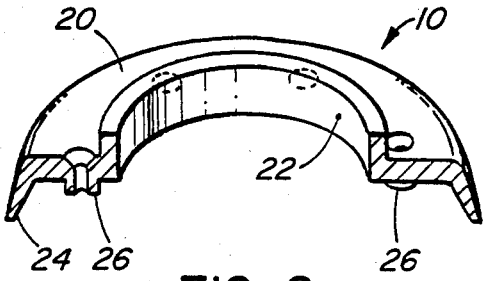
FIG. 2 is a fragmentary, perspective view of a portion of the housing of the present invention.
Figure 1A:
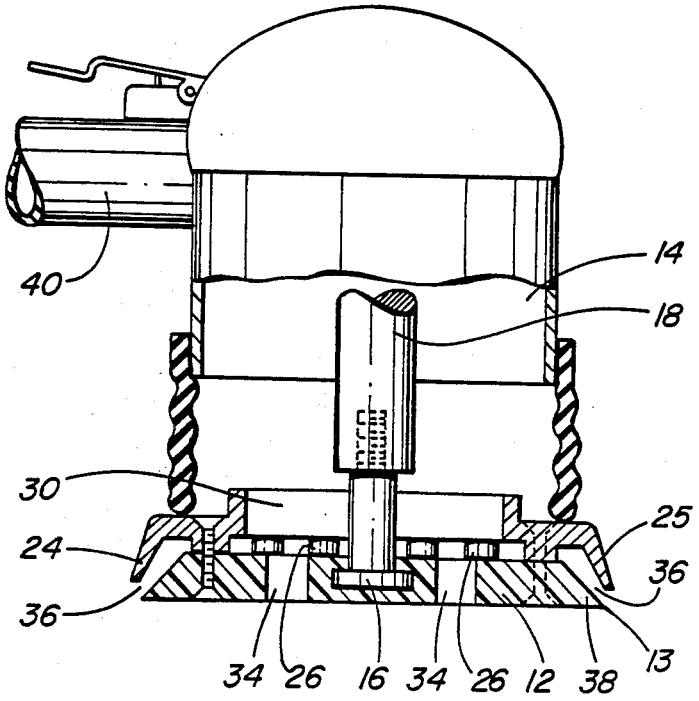
FIG. 1*a* is a modified version of the embodiment of FIG. 1.

Referring to the embodiment of FIGS. 1, 1*a* and 2, the suction plate according to the invention is illustrated as being mounted on the backup pad 12 of a rotary grinder or orbital sander including a vacuum housing 14. The backup pad 12 is connected by a stud 16 to a motor shaft 18 which rotates the backup pad 12 together with an abrasive disc, not shown, mounted on its lower surface.

The suction plate comprises a ring 10 having an upper plate portion 20 of circular configuration including a central, upstanding flange 22 and a peripheral rim 24 depending therefrom, extending outwardly and downwardly from the plate member. If required, the lower surface of the plate member may be provided with a plurality of legs 26 which serve to space the housing plate 20 upwardly from the backup pad 12 as shown in FIG. 1. This spacing can be varied in accordance with the length of the legs 26 used in the particular requirements of the operation. In any case, the spacing of the housing plate 20 above the upper surface of the backup pad 12 defines a vacuum chamber which is in communication with a large vacuum exit or opening 30 defined by the flange 22. In the embodiment of FIG. 1, a resilient sealing collar 32 mounted on the body of the vacuum housing 14 extends downwardly and rests on the upper surface of the housing plate 20. This serves to seal the vacuum chamber so that any air drawn into the chamber must come in either through apertures 34 in the bottom of the abrasive disc and the backup pad 12 or in through the peripheral opening 36 defined between the lower edge of the rim 24 and the sloped surface 38 of the backup pad.

The flexible sealing collar 32 may include a conduit 40 for detachable connection to suitable vacuum means, not shown.

The embodiment of the invention shown in FIG. 1*a* is basically the same as that in FIG. 1 but the conduit 40 is taken off the side of the housing 14 and not the sealing collar 32.

Figure 3:
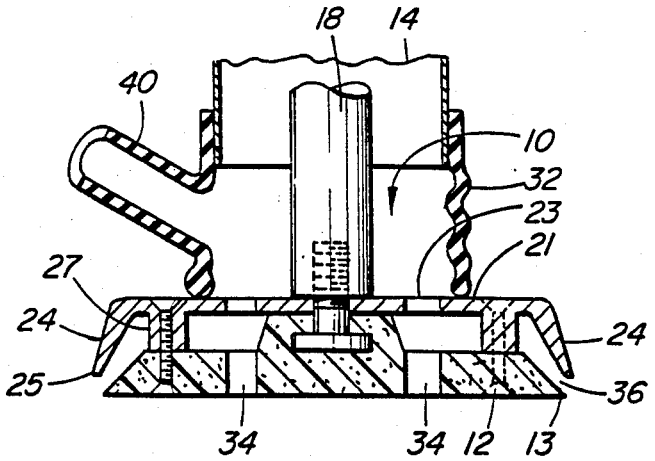
FIG. 3 is a view similar to FIG. 1 but showing a somewhat different arrangement of the housing.

The embodiment of the invention illustrated in FIG. 3 is similar to that shown in FIG. 1 but the backup pad 12 is of somewhat different configuration and the legs 27 spacing the plate 21 above the backup pad are longer than the legs 26 in the embodiment of FIG. 1. Moreover, instead of having a circular opening as defined by the flange 22 in FIG. 1, the plate 21 has a series of apertures 23 which allow passage of air upwardly through the apertures 34 in the backup pad and through the peripheral opening 36 into the chamber defined by the ring 32 and outwardly through the vacuum conduit 40.

It will be appreciated that in either the FIG. 1 or FIG. 3 embodiment, the peripheral edge 25 of the rim 24 and the peripheral edge 13 of the backup pad are coterminous or nearly so with one another so that an operator can move the sanding device right into hard-to-get-at areas such as corners, valleys, etc. The housing 10 can be manufactured from a flexible plastic material so that if the rim 24 contacts any part of the working surface, it will give and then return to its original location.

Figure 4:
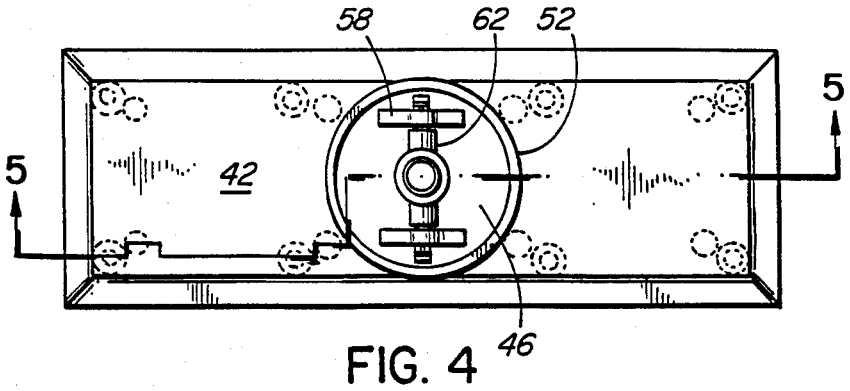
FIG. 4 is a plan view of another embodiment of the invention.
Figure 5:
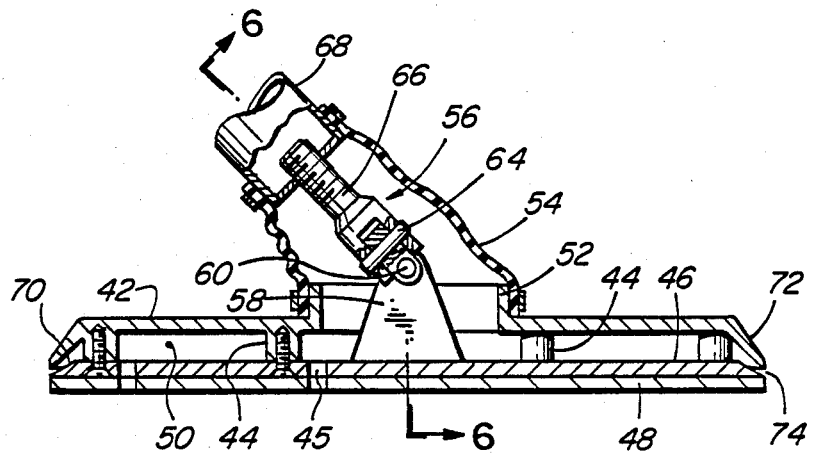
FIG. 5 is a sectional view taken along the line 5—5 of FIG. 4.
Figure 6:
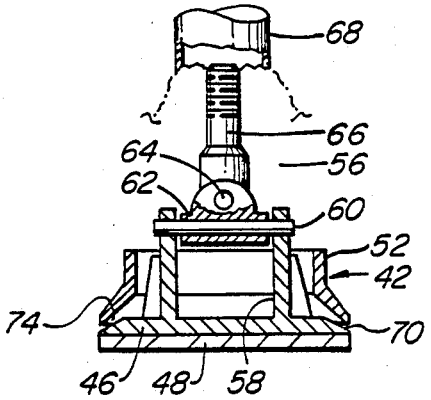
FIG. 6 is a sectional view taken along the line 6—6 of FIG. 5.

Turning now to the embodiment of the invention in FIGS. 4–6, the housing of the embodiment in FIG. 4 consists of an elongated rectangular plate 42 having a series of depending legs 44 which serve to space the plate 42 above a base member 46 and to which is attached a sanding block or backup pad 48. As with the embodiment of FIGS. 1–3, the spacing of the plate 42 above the base member 46 defines a vacuum chamber 50 which is in communication with external vacuum means through a circular upstanding flange 52 to which one end of a flexible tube 54 is connected.

The embodiment of FIGS. 4–6 is provided with a universal joint indicated generally at 56 and includes a pair of upright plate members 58 integral with or otherwise secured to the base member 46 and extending upwardly through the opening defined by the flange 52. Plates 58 support a roll pin 60 to which is attached a T-shaped member 62 allowing horizontal movement in one direction of that T-shaped member. The upper part of member 62 is provided with another roll pin 64 at right angles to pin 60 and it provides horizontal movement to a connector 66 attached to it. The connector in turn is adapted for detachable securement to the terminal end of a vacuum pipe 68 which may also serve the function of an elongated handle for actuating the sander.

Looking at FIGS. 5 and 6, it will be seen that the base member 46 is provided with a chamfered edge portion 70 and the housing plate 42 is, as in FIG. 1, provided with a peripheral rim 72 extending outwardly and downwardly from the plate 42 so that the converging edges of the rim 72 and the chamfered edge of the base plate 46 define a peripheral opening 74. It will also be noted that the edge of the base member 46 and the terminal edge of the rim 72 are coterminous with one another so that an operator can move the sanding device into corners and other hard-to-get-at locations during the sanding operation.

Figure 7:
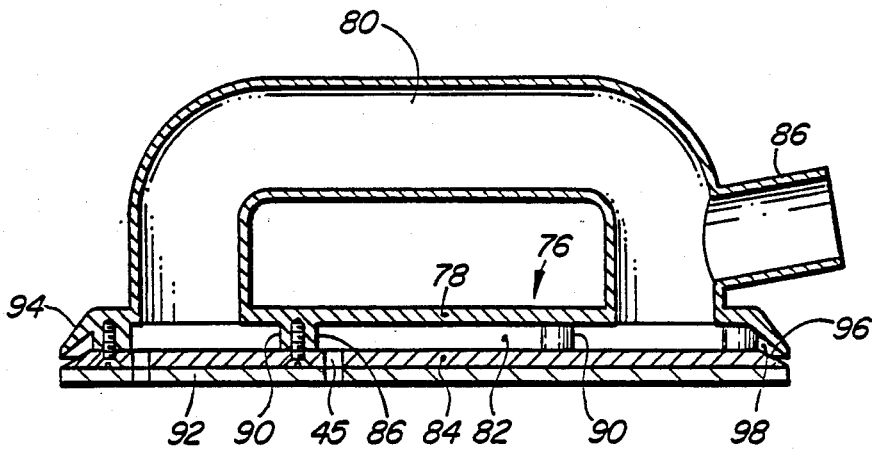
FIG. 7 is a cross sectional view of another embodiment of the invention.

Turning now to FIG. 7, the vacuum sander 76 has the same basic configuration as the sander in FIGS. 4 and 5 but instead of the plate 42 having a central opening for attachment to vacuum means, the housing plate 78 has an integrally formed handle member 80 and as the handle member 80 is of tubular construction, it provides communication between the chamber 82 defined between the plate 78 and the base 84 and external vacuum means, not shown, which is attached to the handle at a suitable outlet 86. As in the embodiment of FIG. 5, the housing plate 78 is attached to the base 84 by suitable screws 86 extending through legs 90, the backup pad or sanding block 92 being attached to the lower end of the base. The peripheral rim 94 of the plate 78 is spaced somewhat from the chamfered edge 96 of the base 84 so that peripheral opening 98 is provided.

Figure 8:
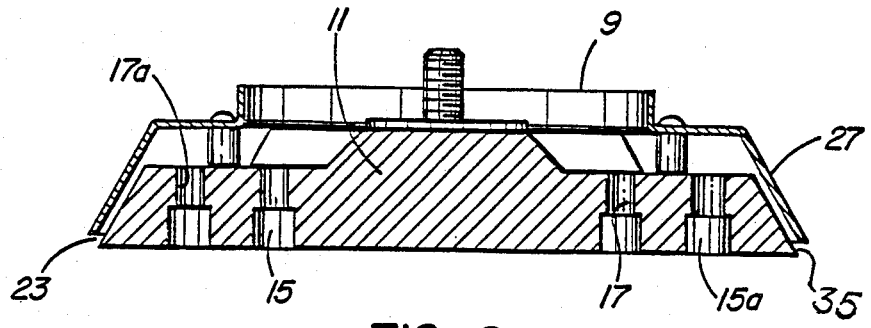
FIG. 8 is a sectional view of another embodiment of the invention.
Figure 9:
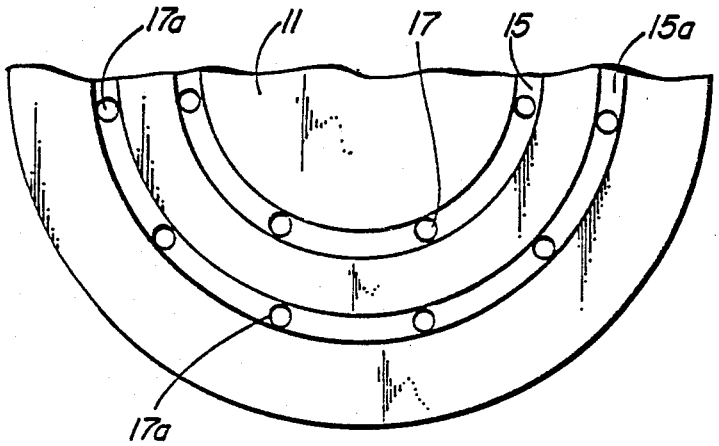
FIG. 9 is a bottom view, partially cut away, of the embodiment of FIG. 8.

Turning now to FIGS. 8 and 9 a suction plate 9 is secured to a backup pad 11 that is provided with at least one circluar suction channel 15, two such channels being illustrated. Depending on work requirements, diameter of the pad, etc. several concentric or one single channel would be used. As seen in FIG. 8, the channels are preferably the same or somewhat greater in width than the diameter of the apertures 17 which are provided in the base of the pad 11. As shown in the bottom view of the pad in FIG. 9, circular channel 15 interconnects apertures 17 while channel 15*a* interconnects apertures 17*a*.

It will be appreciated that with the provision of the suction channels 15, 15*a* it is unnecessary for an operator to line up suction holes in a sanding disc, not shown, with the apertures 17 in the pad and, further, it is unnecessary to use a loading device with a centering pin for that purpose. With the circular suction channels the operator just sticks the paper to the backup pad using the outside diameter of the paper and backup pad as a guide and, while the holes in the paper may not align vertically with the apertures 17 in the pad 11, the holes in the paper will overlie an associated channel 15 or 15*a* so that, in operation, dust is sucked up through the channel 15, then through the aperture 17 and into the housing above. At the same time dust is also being drawn into the peripheral opening 23 between the rim 27 and the adjacent edge 35 of the pad 11.

It will be understood that sanding discs having one or two concentric rings of holes can be used on a pad according to FIGS. 8 and 9.

Figure 10:
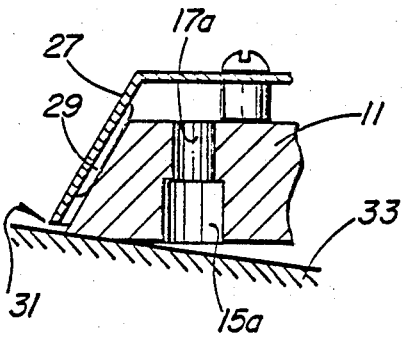
FIG. 10 is a sectional view of a portion of the FIG. 8 embodiment.
Figure 11:
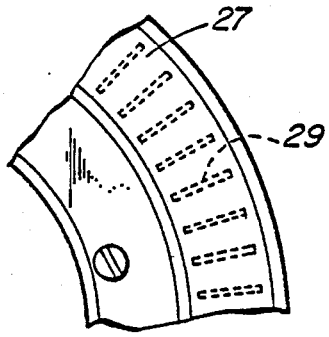
FIG. 11 is a top view of FIG. 10.

Looking to FIGS. 10 and 11, the inside surface 25 of the frusto-conical rim 27 of the housing may be provided with a series of shallow ribs 29, shown in phantom line in FIG. 11. These ribs prevent the closing off of the space 31 between the inside of the suction rim and the adjacent edge of the backup pad when the operator applies downward pressure on the edge of the pad against a work surface 33 as shown in FIG. 10.

Figure 12:
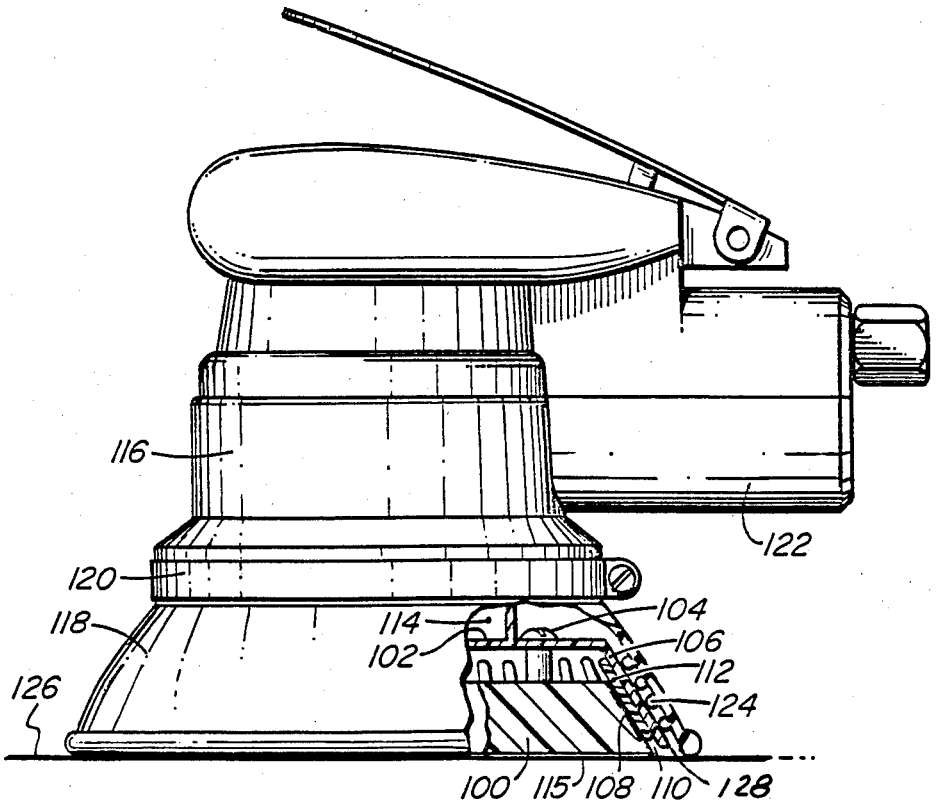
FIG. 12 is a partial sectional view of another emboidment of the invention.

A further embodiment of the invention is illustrated in FIG. 12. A backup pad 100 is provided with a suction plate 102 secured thereto by screws 104. The plate 102, like that shown in FIG. 8, has a depending rim 106 spaced outwardly from the adjacent, sloped edge 108 of the backup pad 100 to provide the peripheral channel 110. While not essential to the operation of the device, the spacing means 112 between the plate rim 106 and the backup pad edge 108 ensure constant spacing between the two surfaces when the working edge of the backup pad 100 flexes upwards and outwards as in FIG. 10. It will be understood that the spacing means can be in the form of ribs integrally formed with the rim 106 of the plate 102 as shown in FIGS. 10, 11 or 12 or they can be formed on the sloped edge of the backup pad 100. Moreover, the spacing means need not be in the form of a rib but would be also effective in the form of projections such as beads or knobs.

In compliance with the embodiment of FIG. 8, the plate 102 has a central opening 114 to allow air and dust to be drawn upwardly through the peripheral channel 110 between the rim 106 and the adjacent backup pad surface 108 and into a vacuum housing 116 and conduit 122. The backup pad and its associcated abrasive disc 115 may have apertures therethrough as in the FIG. 8 embodiment or such apertures can be omitted, as in FIG. 12, particularly if the sanding device is of the double-action or orbital type.

To enhance the gathering of dust at the periphery of the sanding device I have provided an outer, flexible skirt 118, perferably of rubber, having a waist band 120 to secure the skirt to the vacuum housing 116 as shown. Skirt 118 has inwardly directed dimple-like projections 124 to space the skirt 118 from the outer surface of the rim 106. As illustrated, the flexible skirt 118 extends down to, or close to, the work surface 126, depending on the amount of suction being applied. The provision of the adjustable waistband 120 allows room for setting the skirt 118 up or down on the housing 116. It will be understood that if the backup pad 100 is used as a rotary grinder or sander it, together with its suction plate 102 will rotate at high speed under the skirt 118 or, in an orbital mode, backup pad 100 and plate 102 will move in an orbital path under the skirt. In either case, the flexibility of the skirt, which is stationary due to its connection to the housing 116, is prevented from surface wearing contact with the rim 106 by means of the projections 124 and a smooth plastic finish of the rim 106. This allows the backup pad 100 to vibrate and turn under the skirt 106 without wearing away the components. Moreover, an additional peripheral vacuum channel 128 is provided which substantially increases the removal of dust from the work surface.

It will be understood from all embodiments of the present invention that the peripheral opening allows efficient vacuuming of dust that accumulates anywhere around the periphery of the sanding device whether it is circular or horizontal. The dust can be drawn in through the back, sides or front of the device to provide a much more efficient unit than is available in the prior art. The arrangement of the present invention can be used on all rectangular vibrators, hand sanders, pole sanders and disc sanders or long body files. The housing can be made out of various materials such as nylon, fiberglass or various alloys.

The invention is effective either using the peripheral suction alone or in combination with suction apertures such as 34 in FIGS. 1 and 3 or 45 in FIGS. 5 and 7 which extend through the backup pad and or base from the work surface to the vacuum chamber.

While the present invention has been described in connection with specific embodiment thereof and specific uses, various modifications will occur to those skilled in the art without departing from the spirit and scope of the invention as set forth in the appended claims.

The terms and expressions which have been employed in this specification are used as terms of description and not of limitation and there is no intention in the use of such terms and expressions to exclude any equivalence of the features shown and described or portions thereof. It is recognized that various modifications are possible within the scope of the invention claimed.

The embodiments of the invention in which an exclusive property or privilege is claimed are defined as follows:

1. A suction plate for a vacuum sander of the type including a backup pad, said suction plate having means for spacing said plate above the upper surface of said backup pad; a depending rim on the periphery of said plate defining a relatively narrow peripheral opening between the inside surface of said rim and the opposing surface of said backup pad; the lower, peripheral edge of said rim being coterminous, or nearly so, with the peripheral edge of the backup pad; said spacing means comprising leg members on the undersurface of said plate; said rim being directed outwardly and downwardly from the plate to define the narrow peripheral opening between said rim and the edge of the backup pad; at least one opening in the upper surface of the plate to provide communication between said peripheral opening and a vacuum source of said sander; and a plurality of projections on said inside surface of said rim to maintain space between the latter and the opposing surface of said backup pad.

2. A suction plate according to claim 1 wherein said plate and said backup pad are circular and wherein the bottom surface of said backup pad is provided with at least one circular concentric channel; and apertures in the channel extending therefrom through the pad to provide communication between said concentric channel and said opening in the upper surface of said plate.

3. A suction plate according to claim 1 including an exit from said plate for connection to a vacuum source.

4. A suction plate according to claim 1 wherein said plate is circular and adapted for mounting on the upper suface of a circular backup pad.

5. A suction plate according to claim 1 wherein said plate is rectangular and includes a lower, base member spaced from said plate by said leg members, said base being adapted to receive a backup pad on its lower surface; and means on the plate member for connecting the suction plate to a vacuum source.

6. A suction plate for a backup pad of a vacuum sander, said suction plate extending over the upper surface of the backup pad and having a depending, peripheral rim extending outwardly and downwardly over the edge of the backup pad and defining a narrow peripheral opening between said rim and the adjacent edge of the backup pad; at least one opening in the surface of said plate to provide a path of travel for air drawn into said peripheral opening, through the plate and into a vacuum system of the sander, and a flexible skirt adapted to be secured to said vacuum sander and extending downwardly therefrom over the surface of the rim of said suction plate to, or nearly to a surface to be sanded, and means on the inner side of said skirt to maintain a space between said skirt and the rim of the suction plate.

7. A suction plate according to claim 6 wherein said space maintaining means comprises inwardly directed projections to be slidably engaged by the surface of said rim.

8. A suction plate according to claim 6 including means spacing the inside of the suction plate rim from the adjacent edge surface of the backup pad.

9. A suction plate according to claim 8 wherein the spacing means comprises inwardly directed projections on the inside of said rim.

* * * * *